United States Patent [19]

Scholz et al.

[11] 4,053,805

[45] Oct. 11, 1977

[54] ARC DISCHARGE LAMP COMPRISING MERCURY, SCANDIUM AND LITHIUM IODIDE, SCANDIUM EMISSION BEING SUPPRESSED

[75] Inventors: John A. Scholz; Phillip J. Gardner, both of Danvers, Mass.; H. Graham Silver, Kings Point, N.Y.

[73] Assignee: GTE Sylvania Incorporated, Danvers, Mass.

[21] Appl. No.: 530,786

[22] Filed: Dec. 9, 1974

[51] Int. Cl.[2] ..... H01J 17/20; H01J 61/18

[52] U.S. Cl. ..... 313/229; 313/225

[58] Field of Search ..... 313/227, 229

[56] References Cited

U.S. PATENT DOCUMENTS

| | | | |
|---|---|---|---|
| 2,615,140 | 10/1952 | Claessen | 313/227 |
| 3,351,798 | 11/1967 | Bauer | 313/225 |
| 3,398,312 | 8/1968 | Edris et al. | 313/227 X |
| 3,407,327 | 10/1968 | Koury et al. | 313/227 X |
| 3,911,308 | 10/1975 | Akutsu et al. | 313/229 X |

FOREIGN PATENT DOCUMENTS

| | | | |
|---|---|---|---|
| 1,367,267 | 6/1964 | France | 313/227 |

*Primary Examiner*—Robert Segal

*Attorney, Agent, or Firm*—James Theodosopoulos

[57] ABSTRACT

A metal halide arc discharge lamp has a fill including lithium iodide, mercury and scandium. In order to maintain a high efficiency in the red emission of the lamp, the ratio of lithium iodide to scandium must be between about 1.67 and 83.3.

1 Claim, 1 Drawing Figure

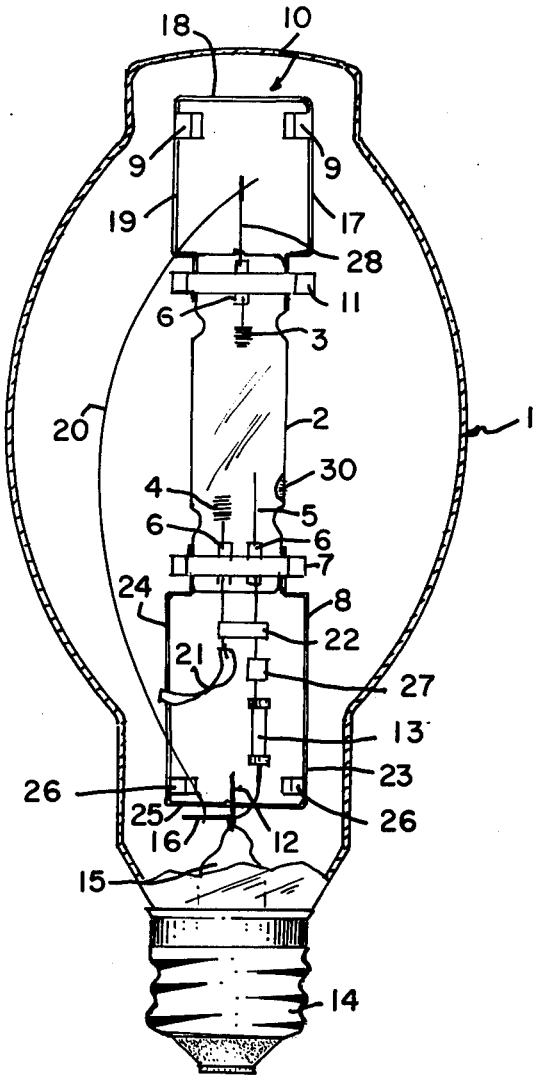
18
10
9
9
19
17
28
11
6
3
20
2
1
30
4
5
6
6
7
24
8
22
21
27
13
23
26
26
25
16
12
15
14

ARC DISCHARGE LAMP COMPRISING MERCURY, SCANDIUM AND LITHIUM IODIDE, SCANDIUM EMISSION BEING SUPPRESSED

THE INVENTION

This invention relates to metal halide arc discharge lamps. Such lamps comprise an arc tube, usually made of fused quartz or other high silica glass, having electrodes disposed therewithin and containing a fill including mercury and a metal halide. Examples of such lamps are shown, and also listed, in U.S. Pat. No. 3,761,758.

This invention is particularly concerned with a metal halide arc discharge lamp, the emission of which is primarily in the red region of the visible spectrum. Such lamps are useful in photoperiodic applications. As pointed out in *Lighting For Plant Growth,* E. D. Bickford and S. Dunn, Kent State University Press, 1972, at page 81, photoperiodism relates to the response of organisms, such as vegetables and flowering plants, to the relative lengths of day and night. The pigment phytochrome, which is responsible for photoperiodism, is activated by red light. The action spectrum for one form of the pigment has a maximum of about 660 nanometers.

Although it is known that lithium can be used in metal halide arc discharge lamps in order to supply a red component to the light emitted therefrom, lithium or lithium halide has not generally been used as the primary light emitting metal of such lamps. Attempts to manufacture lamps having lithium as the primary light emitting metal have been generally unsatisfactory for two reasons. First, the electrodes are subject to attack by lithium iodide. Second, the lamp cannot be started or operated satisfactorily with conventional metal halide lamp ballasts.

We have found that both problems can be solved by adding scandium metal as a component of the arc tube fill. However, in order to avoid reducing the efficiency of the red emission and in order to avoid scandium emission, the quantity of scandium must be controlled. We have found that efficient red emission can be obtained when the weight ratio of lithium iodide to scandium metal is between about 1.67 and 83.3.

The single figure in the drawing is a perspective view of a metal halide lamp containing a fill of materials in accordance with this invention.

As shown in the drawing, a metal halide lamp in accordance with this invention includes a generally tubular outer bulbous envelope 1 having a bulbous central portion and a conventional base 14 attached to the bottom thereof. Extending inwardly from the base and inside of the envelope 1 is a mount 15 having a pair of stiff lead-in wires 12 and 16 in electrical conducting relation with the base 15. Disposed upon one of the stiff lead-in wires 12 is a lower, U-shaped support 8 welded thereto. U-shaped support 8 comprises a pair of vertical wires 23 and 24 rising from a horizontal base wire 25. The upper ends of lower U-shaped support 8 are welded together with a lower strap 7 which in turn supports an arc tube 2. Preferably, the lower strap includes two sections abutting against either side of arc tube 2 thereby holding it firmly in place. They touch only the press seal of the arc tube and not the body. Generally, both sides of the lower strap 7 can be of identical construction. A pair of bumpers 26 are welded to lower U-shaped support 8 and abut against the tubular portion of walls of outer bulbous envelope 1 thereby stabilizing the structure within the lamp. Preferably, these bumpers are made of a resilient material so that if the lamp is jarred they will absorb much of the shock.

Since lower U-shaped support 8 is electrically connected to stiff lead-in wire 12, support 8 forms part of the circuit in the device. Current passes from base 14 into lower U-shaped support 8 and thence to lead-in wire 21 which in turn is connected to a cathode 4 in the arc tube. It is sometimes desirable to place an insulating shield about lead-in wire 21 to prevent arcing within the lamp and between the various elements. Current passes from lead-in wire 21 to cathode 4 through an intermediary molybdenum foil section 6.

The other side of the circuit is formed through stiff lead-in wire 16 which is preferably bent out of place so that parts on one side of the line are insulated from those on the other side. A resistor 13 is attached to stiff lead-in wire 16 through a lead-in wire associated therewith and thence to a connector 27 which in turn leads through a molybdenum foil section 6 to a starting probe 5. A bimetal 22 is disposed between lead-in wire 21 attached to cathode 4 and lead-in wire 27 which is attached to starting probe 5. Bimetal 22 is biased open when the lamp is turned off but when the lamp starts, it biases closed against the lead-in wires to probe 5 thereby establishing the same current potential at probe 5 and cathode 4. Such closing prevents electrolysis between the probe and cathode.

At the other end of arc tube 2, an upper support 10 is mounted within the tubular portion of bulbous envelope 1. Support frame 10 includes a horizontal section 18 having vertical supports 17 and 19 depending downwardly therefrom and attached at the free ends to an upper strap 11 which surrounds the press seal of arc tube 2 and rigidly holds it in place. Preferably, the construction and disposition of upper strap 11 is similar to lower strap 7. A pair of upper bumpers 9 are mounted upon vertical sections 17 and 19 of upper support 10 and resiliently abut against the sides of the tubular portion of bulbous envelope 1. Such disposition prevents breakage of the lamp if the arc tube is shaken or dropped.

A lead-in wire 28 extends to the outside of arc tube 2 and is attached at its inner end to a molybdenum foil section 6 and thence to a cathode 3. An electrical connection is made between stiff lead-in wire 16 and lead-in wire 28 through a thin conducting lead 20 which may be of any suitable conducting material. Preferably, conducting lead 20 is distantly removed from arc tube 2, generally by bending it around the perimeter of outer bulbous envelope 1.

Disposed within arc tube 2 is the usual inert starting gas, such as neon, argon, xenon and the like and a filler substance 30 which generally exists in the form of a globule during quiescent non-operating condition of the lamp. Filler 30 comprises mercury and lithium iodide and can also contain scandium metal. The scandium may alternatively be placed within arc tube 2 by welding a small chip thereof to one of the electrodes.

In one example of a 400 watt lamp in accordance with this invention, are tube 2 contained argon at 35 torr and had a fill of 50 mg mercury, 10 mg lithium iodide and 0.6 mg of scandium metal. The 400 watt arc tube had a volume of 13.7 cc, an inside diameter of 20 mm and an arc length of 45 mm. After a suitable burn-in period to reduce and stabilize reignition voltage, the lamp readily started and sustained operation on a conventional metal halide 400 watt ballast, which has an open circuit voltage of 290 volts. After 1000 hours operation there was little or no evidence of electrode attack.

Maintenance data were taken on this lamp for the most sensitive persistent line of lithium which is 670.8 nanometers. This line is very close to the action maximum of 660 nanometers for phytochrome. At 500 hours, watts emitted per nanometer was 3.7; at 1000 hours, this decreased slightly to 3.3.

The lamp efficiency at the desired spectral frequence is also dependent on the quantity of lithium iodide present. For example, the same 400 watt arc tube, in which the quantity of lithium iodide was reduced from 10 mg to 5 mg, had a 1000 hour efficiency, at 670.8 nanometers, of 2.4 watts per nanometer. For purposes of this invention, the quantity of lithium iodide should be between .073 and 3.65 mg per cc of arc tube volume.

We claim:

1. A red emitting metal halide arc discharge lamp comprising an arc tube having sealed ends and electrodes disposed in said ends and a fill within said arc tube comprising mercury, scandium and lithium iodide, the relationship between the scandium and the lithium iodide being such that lithium is the primary light emitting metal and scandium emission is suppressed.

* * * * *